US009416639B2

(12) United States Patent
Whitney et al.

(10) Patent No.: US 9,416,639 B2
(45) Date of Patent: Aug. 16, 2016

(54) COMBINED RF HEATING AND GAS LIFT FOR A HYDROCARBON RESOURCE RECOVERY APPARATUS AND ASSOCIATED METHODS

(71) Applicant: Harris Corporation, Melbourne, FL (US)

(72) Inventors: Ryan Matthew Whitney, Indialantic, FL (US); Keith Nugent, Palm Bay, FL (US); Raymond C. Hewit, Palm Bay, FL (US); Brian N. Wright, Indialantic, FL (US)

(73) Assignee: HARRIS CORPORATION, Melbourne, FL (US)

( * ) Notice: Subject to any disclaimer, the term of this patent is extended or adjusted under 35 U.S.C. 154(b) by 398 days.

(21) Appl. No.: 14/153,210

(22) Filed: Jan. 13, 2014

(65) Prior Publication Data

US 2015/0198020 A1 Jul. 16, 2015

(51) Int. Cl.

| | |
|---|---|
| ***E21B 36/04*** | (2006.01) |
| ***E21B 43/24*** | (2006.01) |
| ***E21B 43/12*** | (2006.01) |

(52) U.S. Cl.

CPC ..... *E21B 43/24* (2013.01); *E21B 43/122* (2013.01)

(58) Field of Classification Search

CPC ... E21B 43/121; E21B 43/122; E21B 43/123; E21B 43/24; E21B 43/2401; E21B 36/005; E21B 36/006; E21B 36/04; E21B 36/001

USPC ..... 166/272.1, 372, 263, 60; 417/109; 392/301

See application file for complete search history.

(56) References Cited

U.S. PATENT DOCUMENTS

| | | | | |
|---|---|---|---|---|
| 5,065,819 | A | 11/1991 | Kasevich | |
| 5,236,039 | A | 8/1993 | Edelstein et al. | |
| 6,189,611 | B1 | 2/2001 | Kasevich | |
| 7,441,597 | B2 | 10/2008 | Kasevich | |
| 7,770,602 | B2 | 8/2010 | Buschhoff | |
| 7,891,421 | B2 | 2/2011 | Kasevich | |
| 8,210,256 | B2 * | 7/2012 | Bridges | E21B 36/04 166/248 |
| 9,103,205 | B2 * | 8/2015 | Wright | E21B 43/25 |
| 9,140,099 | B2 * | 9/2015 | Parsche | E21B 36/001 |
| 2003/0178195 | A1 * | 9/2003 | Agee | C10G 2/32 166/248 |
| 2007/0137852 | A1 | 6/2007 | Considine et al. | |
| 2012/0090844 | A1 | 4/2012 | Madison et al. | |
| 2012/0234536 | A1 | 9/2012 | Wheeler et al. | |
| 2012/0234537 | A1 | 9/2012 | Sultenfuss et al. | |
| 2012/0267110 | A1 | 10/2012 | Meurer et al. | |
| 2012/0318498 | A1 | 12/2012 | Parsche | |
| 2013/0248179 | A1 | 9/2013 | Yeh et al. | |
| 2013/0251547 | A1 | 9/2013 | Hansen | |
| 2015/0337637 | A1 * | 11/2015 | Wright | E21B 43/25 166/248 |

* cited by examiner

*Primary Examiner* — Kenneth L Thompson

(74) *Attorney, Agent, or Firm* — Allen, Dyer, Doppelt, Milbrath & Gilchrist, P.A. Attorneys at Law

(57) ABSTRACT

A hydrocarbon resource recovery apparatus for a subterranean formation having a wellbore extending therein includes a radio frequency (RF) power source, a gas source, and an RF antenna within the wellbore. An RF transmission line extends within the wellbore between the RF power source and the RF antenna and is coupled to the gas source to be cooled and/or pressure balanced by a flow of gas therefrom. At least one of the RF antenna and RF transmission line define a gas lift passageway coupled to the gas source to lift hydrocarbon resources within the wellbore.

24 Claims, 9 Drawing Sheets

COMBINED RF HEATING AND GAS LIFT FOR A HYDROCARBON RESOURCE RECOVERY APPARATUS AND ASSOCIATED METHODS

FIELD OF THE INVENTION

The present invention relates to the field of hydrocarbon resource recovery, and, more particularly, to hydrocarbon resource recovery using RF heating and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands or heavy oils. Estimates are that trillions of barrels of oil reserves may be found in such oil sand formations.

Recovery of highly viscous hydrocarbon resources may be enhanced by heating the oil in-situ to reduce its viscosity and assist in movement. One approach is known as Steam-Assisted Gravity Drainage (SAGD). The oil is immobile at reservoir temperatures, and therefore, is typically heated to reduce its viscosity. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

Another approach for heating the oil is based on the use of radio frequency (RF) energy. U.S. Pat. No. 7,441,597 to Kasevich discloses using an RF generator to apply RF energy to an RF antenna in a horizontal portion of an RF well positioned above a horizontal portion of an oil producing well. The viscosity of the oil is reduced as a result of the RF energy, which causes the oil to drain due to gravity. The oil is recovered through the oil/gas producing well.

Instead of having separate RF and oil/gas producing wells, U.S. Published Patent Application No. 2012/0090844 to Madison et al. discloses a method of producing upgraded hydrocarbons in-situ from a production well. The method begins by operating a subsurface recovery of hydrocarbons with a production well. An RF absorbent material is heated by at least one RF antenna adjacent the production well and used as a heated RF absorbent material, which in turn heats the hydrocarbons to be produced.

Another method for heating heavy oil directly inside a production well is disclosed in U.S. Published Patent Application No. 2012/0234536 to Wheeler et al. The method disclosed in Wheeler et al. raises the subsurface temperature of heavy oil by utilizing an activator that has been injected below the surface. The activator is then excited using at least one RF antenna adjacent the production well, wherein the excited activator then heats the heavy oil.

Instead of placing the RF antenna adjacent the production well, the RF antenna may be placed within the production well, as disclosing in U.S. Published Patent Application No. 2007/0137852 to Condsidine et al. In Condsidine et al., a combination of electrical energy and critical fluids with reactants are placed within a borehole to initiate a reaction of reactants in the critical fluids with kerogen in the oil shale thereby raising the temperatures to cause kerogen oil and gas products to be extracted as a vapor, liquid or dissolved in the critical fluids. The hydrocarbon fuel products of kerogen oil or shale oil and hydrocarbon gas are removed to the ground surface by a product return line. An RF generator provides RF energy to an RF antenna within the production well.

The use of RF energy to recover hydrocarbon resources increases the capital cost and operating cost for a hydrocarbon resource recovery apparatus. Consequently, there is a need to improve upon the use of applying RF energy to heat hydrocarbon resources within a subterranean formation.

SUMMARY OF THE INVENTION

In view of the foregoing background, it is therefore an object of the present invention to reduce capital cost and operating cost for a hydrocarbon resource recovery apparatus using RF energy to heat hydrocarbon resources within a subterranean formation.

This and other objects, features, and advantages in accordance with the present invention are provided by a hydrocarbon resource recovery apparatus for a subterranean formation having a wellbore extending therein. The apparatus may comprise a radio frequency (RF) power source, a gas source, and an RF antenna within the wellbore. An RF transmission line may extend within the wellbore between the RF power source and the RF antenna and may be coupled to the gas source to be cooled by a flow of gas therefrom. At least one of the RF antenna and RF transmission line may define a gas lift passageway coupled to the gas source to lift hydrocarbon resources within the wellbore.

The hydrocarbon resource recovery apparatus advantageously combines the RF antenna with the artificial gas lift within the same wellbore. This allows the flow of gas to be used to cool the RF transmission line while providing a dielectric medium and pressure balance. By using the flow of gas for two different functions, capital costs and operating costs for the hydrocarbon resource recovery apparatus may be reduced.

The RF transmission line may comprise an inner conductor and an outer conductor surrounding the inner conductor in space relation therefrom. The RF antenna may surround the outer conductor in spaced relation therefrom, and may be configured as a dipole RF antenna.

The gas source may comprise a nitrogen source or a natural gas source, for example. The flow of gas may be used to cool the RF transmission line in a number of different embodiments. In one embodiment, the inner conductor may have a cooling fluid passageway therethrough coupled to the gas source. In another embodiment, the space between the inner and outer conductors may define the cooling fluid passageway coupled to the gas source. In yet another embodiment, the space between the outer conductor and the RF antenna may define a cooling fluid passageway coupled to the gas source.

Similarly, the hydrocarbon resources may be pumped from the wellbore in a number of different embodiments. In one embodiment, the inner conductor has a hydrocarbon resource recovery passageway therethrough in fluid communication with the gas lift passageway to lift hydrocarbon resources from the wellbore. In another embodiment, the space between the inner and outer conductors defines a hydrocarbon resource recovery passageway in fluid communication with the gas lift passageway to lift hydrocarbon resources from the wellbore. In yet another embodiment, the space between the outer conductor and the RF antenna defines a hydrocarbon resource recovery passageway in fluid communication with the gas lift passageway to lift hydrocarbon resources from the wellbore.

Another aspect is directed to a hydrocarbon resource recovery method for a subterranean formation having a wellbore extending therein. The method may comprise operating an RF transmission line extending within the wellbore and coupled between an RF power source and an RF antenna within the wellbore and coupled to a gas source and cooled by a flow of gas therefrom. A gas lift passageway defined by at least one of the RF antenna and RF transmission line and coupled to the gas source may be operated to lift hydrocarbon resources within the wellbore.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notations are used to indicate similar elements in alternative embodiments.

Figure 1:
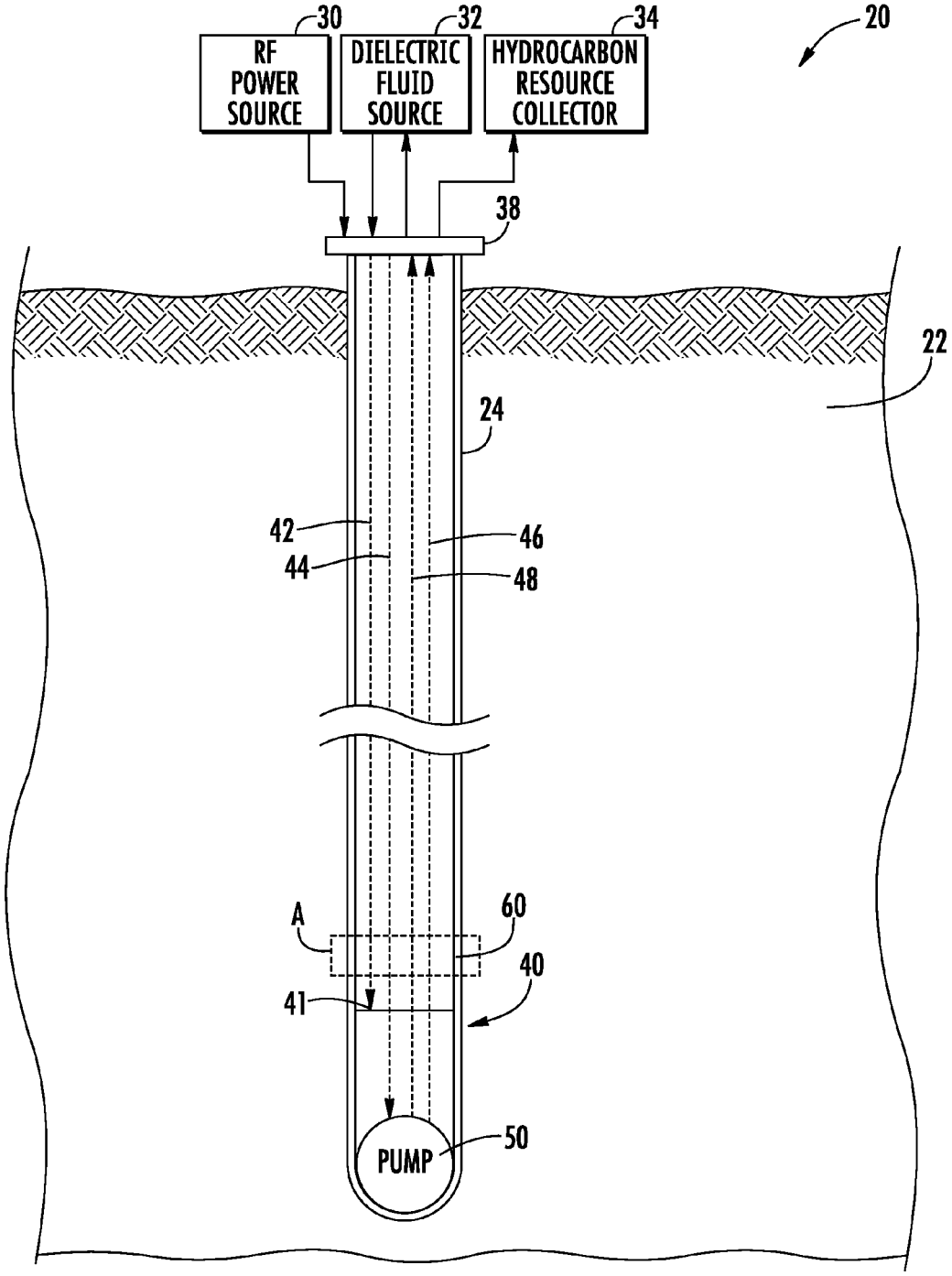
FIG. 1 is a schematic diagram of a hydrocarbon resource recovery apparatus for a subterranean formation with a hydrocarbon resource recovery pump in accordance with the present invention.

Referring initially to FIG. 1, a hydrocarbon resource recovery apparatus 20 for a subterranean formation 22 with a hydrocarbon resource recovery pump 50 will now be discussed. The subterranean formation 22 has a wellbore 24 extending therein. The hydrocarbon resource recovery apparatus 20 includes a radio frequency (RF) power source 30, a dielectric fluid source 32, and an RF antenna 40 within the wellbore 24. An RF transmission line 42 extends within the wellbore 24 between the RF power source 30 and to a feed point 41 of the RF antenna 40 and is coupled to the dielectric fluid source 32 to be cooled by a flow of dielectric fluid 44 therefrom while providing a dielectric medium and pressure balance.

A hydrocarbon resource recovery pump 50 is within the wellbore 24 and is also coupled to the dielectric fluid source 32 to be powered by the flow of dielectric fluid 44 therefrom. A return flow of dielectric fluid 48 is provided back to the dielectric fluid source 32 from the hydrocarbon resource recovery pump 50.

The hydrocarbon resource recovery pump 50 pumps hydrocarbon resources 46 to a hydrocarbon resource collector 34 above the subterranean formation 22. The hydrocarbon resource collector 34 is a storage tank or pipeline, for example.

The hydrocarbon resource recovery apparatus 20 advantageously uses the dielectric fluid to power the hydrocarbon resource recovery pump 50 and to also cool the RF transmission line 42. By using the same dielectric fluid for two different functions, capital costs and operating costs for the illustrated hydrocarbon resource recovery apparatus 20 may be reduced.

The wellbore 24 extends in a vertical direction, as illustrated. Alternatively, the wellbore 24 may extend in a horizontal direction. The RF power source 30, the dielectric fluid source 32, and the hydrocarbon resource collector 34 are coupled to a wellhead 38 above the wellbore 24 in the subterranean formation 22.

Although the hydrocarbon resource recovery pump 50 is illustrated at the bottom of the wellbore 24 below the RF antenna 40, the pump may be located any where within the wellbore. For example, the hydrocarbon resource recovery pump 50 may be to the side or even above the RF antenna 40.

The hydrocarbon resource recovery pump 50 may be a jet pump, a piston pump, a diaphragm pump or a turbine, for example. Each one of these pump types is powered by the flow of dielectric fluid 44, which is pressurized from the dielectric fluid source 32. The dielectric fluid is typically a dielectric mineral oil and may be referred to as a power fluid. Operation of the hydrocarbon resource recovery pump 50 is a closed loop pump, and the return flow of dielectric fluid 48 is provided back to the dielectric fluid source 32.

Due to the potential length of the RF transmission line 42 and the losses associated therewith, increased RF power may need to be applied by the RF power source 30. Increased RF power at the RF power source 30 causes the operating temperature of the RF transmission line 42 within the subterranean formation 22 to increase. Routing the flow of dielectric fluid 44 intended for the hydrocarbon resource recovery pump 50 to also contact the RF transmission line 42 advantageously helps to cool the RF transmission line while providing a dielectric medium and pressure balance.

The RF antenna 40 transmits RF energy outwards from the wellbore 24. The RF energy increases the temperature of the hydrocarbon resources to be recovered, thus reducing its viscosity and allowing it to be more easily collected. The RF antenna 40 may be configured as a dipole antenna. Included with the RF antenna 40 is the antenna feed point 41, as well as isolators and common mode mitigation (e.g., chokes) to prevent currents from traveling to the surface, as readily appreciated by those skilled in the art.

A passageway within the wellbore 24 used to collect the hydrocarbon resources 46 may also be adjacent with or below the RF antenna 40. Collection of the hydrocarbon resources 46 within a wellbore is typically accomplished using a separate production tubing. However, in the illustrated embodiment, the production tubing is now positioned inside of the RF antenna 40. This advantageously allows the tubing to extend to a bottom of the wellbore 24 to increase the amount of hydrocarbon resources that can be recovered in the wellbore 24. In contrast, if conductive production tubing was placed outside of the RF antenna 40, then the RF energy emitted by the RF antenna would be partially blocked. In this case, the externally placed production tubing would have to terminate above the RF antenna, which would allow for a lesser amount of hydrocarbon resources to be recovered in the wellbore 24.

Figure 2:
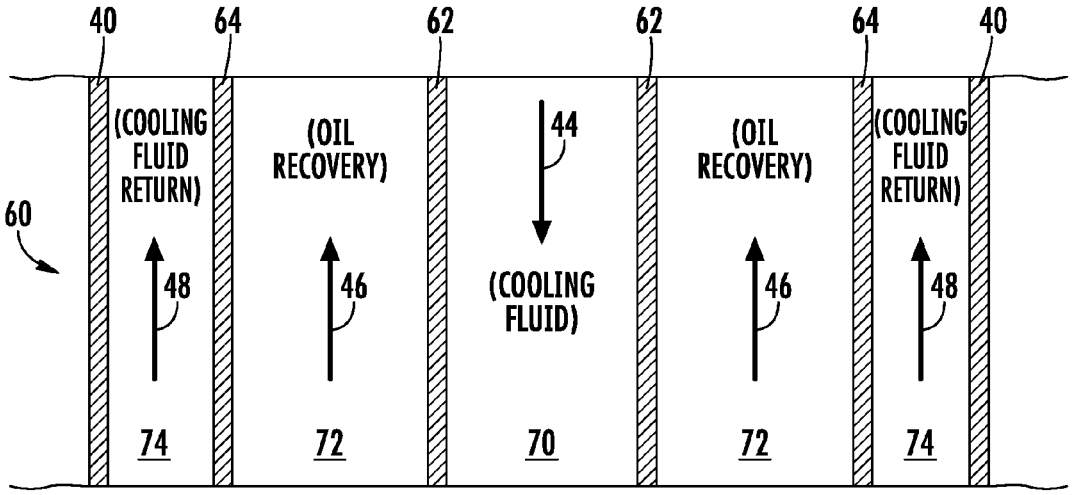
FIG. 2 is an enlarged cross-sectional view of the hydrocarbon resource recovery apparatus within section A of the wellbore in FIG. 1.

A cross-sectional view taken at section A in FIG. 1 of the wellbore 24, which includes the RF antenna 40, will now be discussed with reference to FIG. 2. Extending within this section of the well-bore 24 is a tubular pipe 60 that includes an inner conductor 62, an outer conductor 64 and the RF antenna 40. As will be discussed below, the tubular pipe 60 also provides a plurality of spaced apart passageways extending therethrough. These passageways extend from the wellhead 38 to the hydrocarbon resource recovery pump 50.

The RF transmission line 42 is defined by the inner conductor 62 and the outer conductor 64, with the outer conductor 64 surrounding the inner conductor in space relation therefrom. The inner conductor 62 has a cooling fluid passageway 70 therethrough coupled to the dielectric fluid source 32. The cooling fluid passageway 70 is for the flow of dielectric fluid 44. The RF antenna 40 surrounds the outer conductor 64 in spaced relation therefrom. The RF transmission line 42 may comprise rigid or flexible inner and outer conductors. However, in alternative embodiments, the inner and outer conductors may be in a side-by-side configuration, as readily appreciated by those skilled in the art.

The space between the inner and outer conductors 62, 64 defines a hydrocarbon resource recovery passageway 72 coupled to the hydrocarbon resource recovery pump 50 to pump hydrocarbon resources 46 from the wellbore 24. The space between the outer conductor 64 and the RF antenna 40 defines a cooling fluid return passageway 74 for the return flow of dielectric fluid 48 back to the dielectric fluid source 32 from the hydrocarbon resource recovery pump 50.

Alternatively, the hydrocarbon resource recovery passageway 72 and the return cooling fluid return passageway 74 may be swapped. That is, the space between the outer conductor 64 and the RF antenna 40 defines the hydrocarbon resource recovery passageway 72, and the space between the inner and outer conductors 62, 64 defines the cooling fluid return passageway 74.

As also readily appreciated by those skilled in the art, the return flow of dielectric fluid 48 back to the dielectric fluid source 32 from the hydrocarbon resource recovery pump 50 may be provided in a separate tubing that is external the tubular pipe 60.

Figure 3:
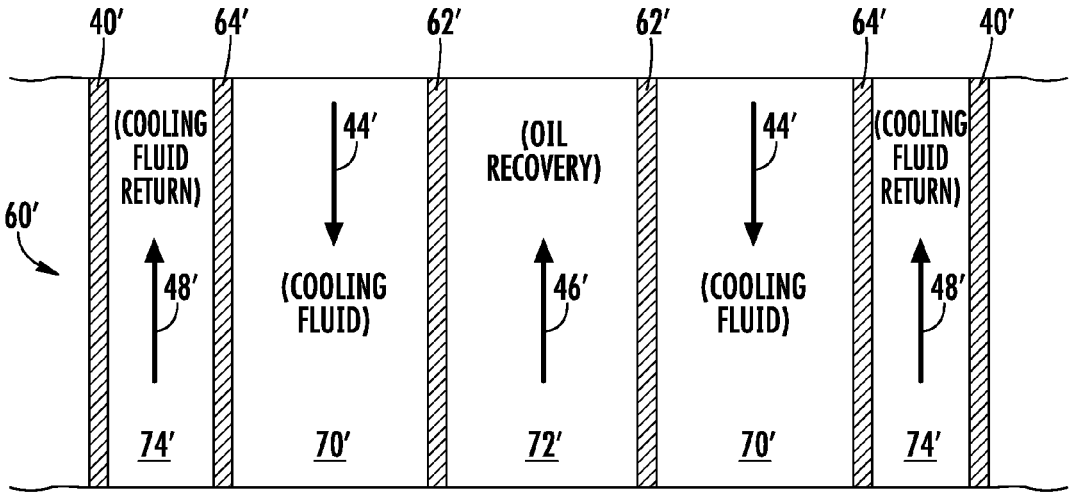
FIG. 3 is an enlarged cross-sectional view of another embodiment of the hydrocarbon resource recovery apparatus within section A of the wellbore in FIG. 1.

Another embodiment of the cross-sectional view of the wellbore 24' at section A will now be discussed with reference to FIG. 3. In this embodiment, the RF transmission line 42' is still defined by the inner conductor 62' and the outer conductor 64', with the outer conductor 64' surrounding the inner conductor in space relation therefrom. However, the space between the inner and outer conductors 62', 64' now defines the cooling fluid passageway 70' coupled to the dielectric fluid source 32'. The cooling fluid passageway 70' is for the flow of dielectric fluid 44'. The RF antenna 40' surrounds the outer conductor 64' in spaced relation therefrom.

The inner conductor 62' has the hydrocarbon resource recovery passageway 72' coupled to the hydrocarbon resource recovery pump 50' to pump hydrocarbon resources from the wellbore 24'. The space between the outer conductor 42(2)' and the RF antenna 40' defines the cooling fluid return passageway 74' for the return flow of dielectric fluid 48' back to the dielectric fluid source 32' from the hydrocarbon resource recovery pump 50'.

Alternatively, the hydrocarbon resource recovery passageway 72' and the return cooling fluid return passageway 74' may be swapped. That is, the space between the outer conductor 64' and the RF antenna 40' defines the hydrocarbon resource recovery passageway 72', and the inner conductor 62' has the cooling fluid return passageway 74'.

As also readily appreciated by those skilled in the art, the return flow of dielectric fluid 48' back to the dielectric fluid source 32' from the hydrocarbon resource recovery pump 50' may be provided in a separate tubing that is external the tubular pipe 60'.

Figure 4:
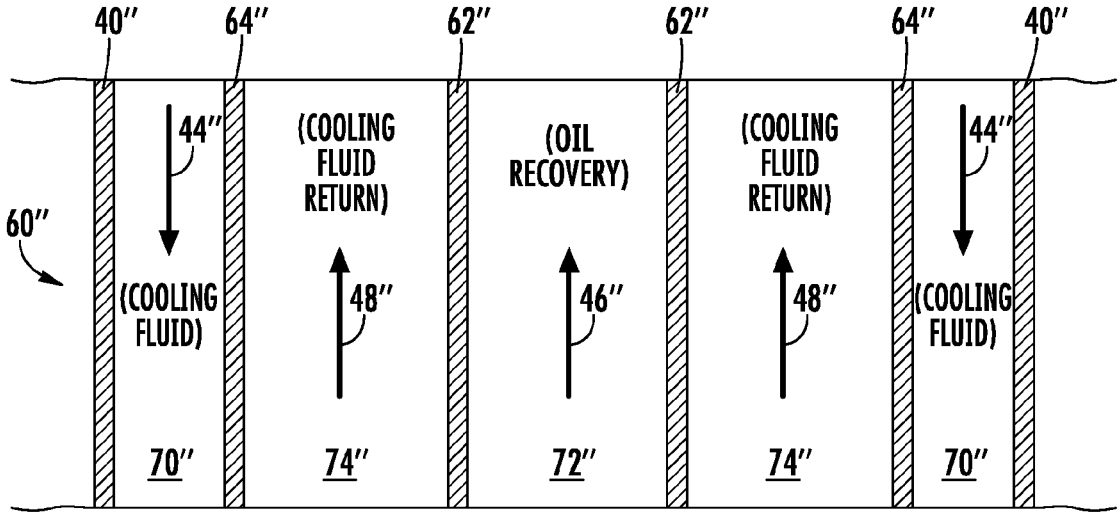
FIG. 4 is an enlarged cross-sectional view of yet another embodiment of the hydrocarbon resource recovery apparatus within section A of the wellbore in FIG. 1.

Yet another embodiment of the cross-sectional view of the wellbore 24" at section A will now be discussed with reference to FIG. 4. In this embodiment, the RF transmission line 42" is still defined by the inner conductor 62" and the outer conductor 64", with the outer conductor 64" surrounding the inner conductor in space relation therefrom. However, the space between the outer conductor 64" and the antenna 40" now defines the cooling fluid passageway 70" coupled to the dielectric fluid source 32". The cooling fluid passageway 70" is for the flow of dielectric fluid 44".

The inner conductor 62" has a hydrocarbon resource recovery passageway 72" coupled to the hydrocarbon resource recovery pump 50" to pump hydrocarbon resources from the wellbore 24". The space between the inner and outer conductors 62", 64" defines the cooling fluid return passageway 74" for the return flow of dielectric fluid 48" back to the dielectric fluid source 32" from the hydrocarbon resource recovery pump 50".

Alternatively, the hydrocarbon resource recovery passageway 72" and the return cooling fluid return passageway 74" may be swapped. That is, the space between the inner and outer conductors 62", 64" defines the hydrocarbon resource recovery passageway 72", and the inner conductor has the cooling fluid return passageway 74".

As also readily appreciated by those skilled in the art, the return flow of dielectric fluid 48" back to the dielectric fluid source 32" from the hydrocarbon resource recovery pump 50" may be provided in a separate tubing that is external the tubular pipe 60".

Figure 5:
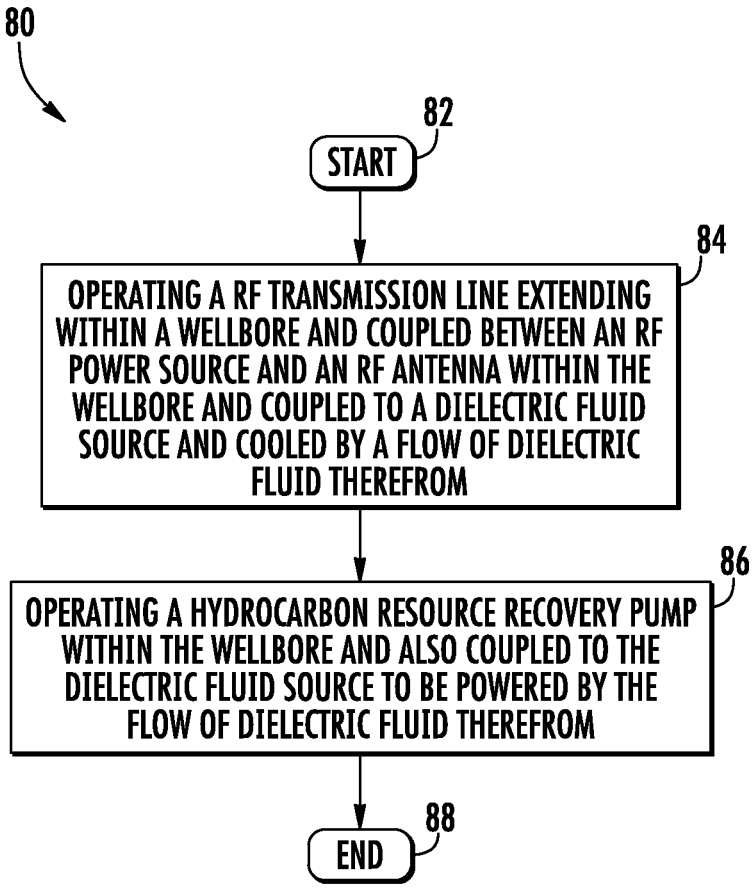
FIG. 5 is a flowchart for a hydrocarbon resource recovery method for a subterranean formation having a wellbore extending therein as illustrated in FIG. 1.

Referring now to the flowchart 80 in FIG. 5, a hydrocarbon resource recovery method for a subterranean formation 22 having a wellbore 24 extending therein includes, from the start (Block 82), operating the RF transmission line 42 at Block 84 extending within the wellbore 24 and coupled between the RF power source 30 and the RF antenna 40 within the wellbore and coupled to the dielectric fluid source 32 and cooled by a flow of dielectric fluid therefrom. The hydrocarbon resource recovery pump 50 is operated at Block 86 within the wellbore 24 and is also coupled to the dielectric fluid source 32 to be powered by the flow of dielectric fluid therefrom. The method ends at Block 88.

Figure 6:
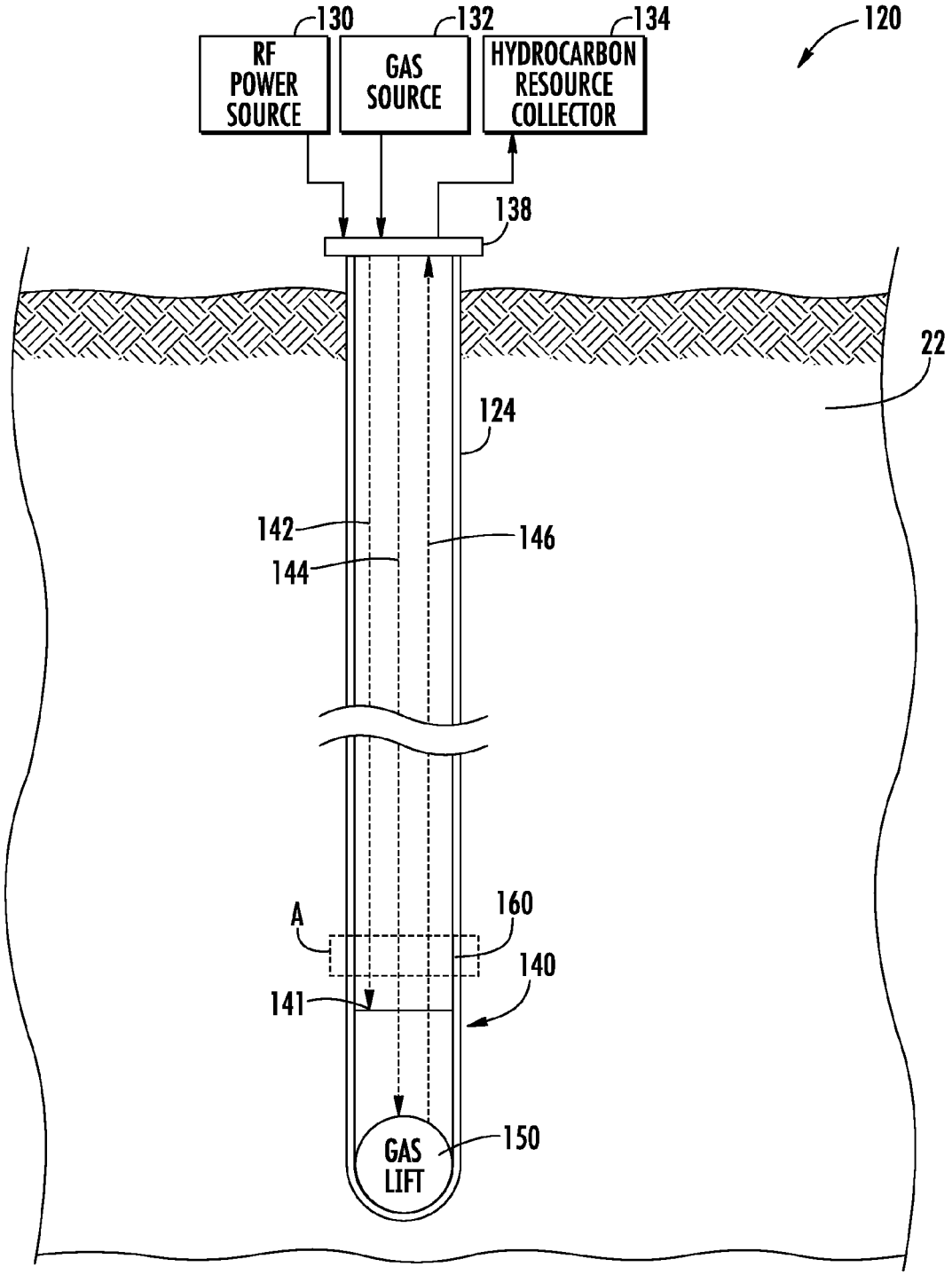
FIG. 6 is a schematic diagram of a hydrocarbon resource recovery apparatus for a subterranean formation with a gas lift in accordance with the present invention.

Referring now to FIG. 6, another aspect of the invention is directed to a hydrocarbon resource recovery apparatus 120 for a subterranean formation 122 with a gas lift 150. The gas lift 150 is an artificial lift method, as readily appreciated by those skilled in the art. The subterranean formation 122 has a wellbore 124 extending therein. The hydrocarbon resource recovery apparatus 120 includes a radio frequency (RF) power source 130, a gas source 132, and an RF antenna 140 within the wellbore 124.

An RF transmission line 142 extends within the wellbore 124 between the RF power source 130 and to a feed point 141 of the RF antenna 140 and is coupled to the gas source 132 to be cooled by a flow of gas 144 therefrom while providing a dielectric medium and pressure balance, At least one of the RF antenna 140 and RF transmission line 142 defines a gas lift passageway at the gas lift 150, with the gas lift passageway coupled to the gas source 132 to lift hydrocarbon resources 146 within the wellbore 124.

The flow of gas 144 from the gas source 132 is injected into the gas lift passageway at the gas lift 150 to lift a mixture of the gas and the hydrocarbon resources 146 to a hydrocarbon resource collector 134 above the subterranean formation 122. The hydrocarbon resource collector 134 is a storage tank or pipeline, for example.

The flow of gas 144 into the gas lift passageway reduces the weight of the hydrostatic column therein, which in turn reduces the back pressure and allows the reservoir pressure within the subterranean formation 122 to push the mixture of the gas and hydrocarbons resources 146 up to the surface. The gas lift passageway may include side pocket mandrels or gas lift injection valves to further assist with lifting of the mixture of the gas and hydrocarbons resources 146 up to the surface. The gas from the gas source 132 may be nitrogen or natural gas, for example.

The hydrocarbon resource recovery apparatus 120 advantageously combines the RF antenna 140 with the artificial gas lift 150 within the same wellbore 122. This allows the flow of gas 144 to be used as a dielectric medium to pressure balance and to cool the RF transmission line 142. By using the flow of gas 144 for two different functions, capital costs and operating costs for the illustrated hydrocarbon resource recovery apparatus 120 may be reduced.

The wellbore 124 extends in a vertical direction, as illustrated. Alternatively, the wellbore 124 may extend in a horizontal direction. The RF power source 130, the gas source 132, and the hydrocarbon resource collector 134 are coupled to a wellhead 138 above the wellbore 124 in the subterranean formation 122.

Due to the potential length of the RF transmission line 142 and the losses associated therewith, increased RF power may need to be applied by the RF power source 130. Increased RF power at the RF power source 130 causes the operating temperature of the RF transmission line 142 within the subterranean formation 122 to increase. Routing the flow of gas 144 to also contact the RF transmission line 142 advantageously helps to cool the RF transmission line while providing a dielectric medium and pressure balance.

The RF antenna 140 transmits RF energy outwards from the wellbore 124. The RF energy increases the temperature of the hydrocarbon resources to be recovered, thus reducing its viscosity and allowing it to be more easily collected. The RF antenna 140 may be configured as a dipole antenna. Included with the RF antenna 140 is the antenna feed point 141, as well as isolators and common mode mitigation (e.g., chokes) to prevent currents from traveling to the surface, as readily appreciated by those skilled in the art.

The gas lift passageway used to collect the hydrocarbon resources 146 within the gas lift 150 is positioned below the RF antenna 140. This advantageously allows the gas lift passageway to extend to a bottom of the wellbore 24 to increase the amount of hydrocarbon resources that can be recovered in the wellbore 24. The gas lift passageway may also be referred to as production tubing.

Figure 7:
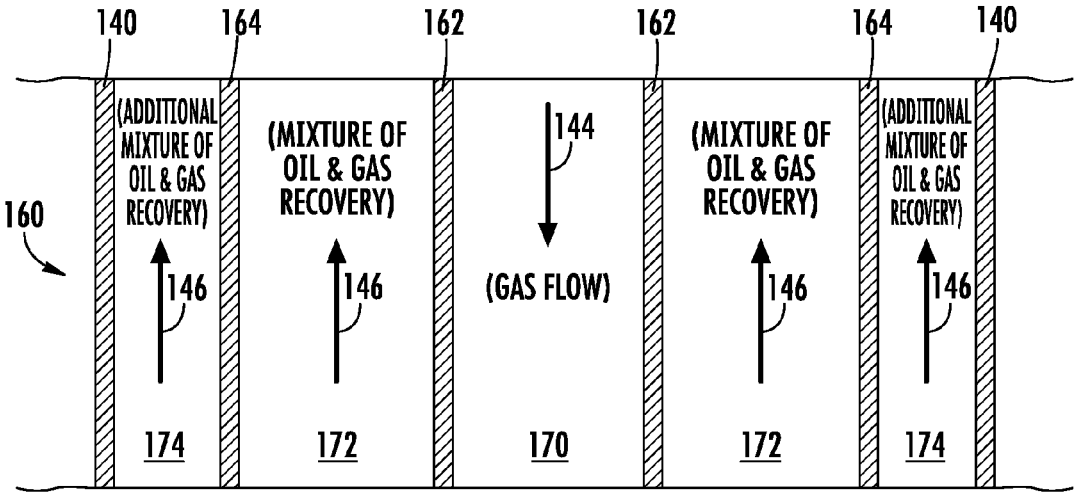
FIG. 7 is an enlarged cross-sectional view of the hydrocarbon resource recovery apparatus within section A of the wellbore in FIG. 6.

A cross-sectional view taken at section A in FIG. 6 of the wellbore 124, which includes the RF antenna 140, will now be discussed with reference to FIG. 7. Extending within this section of the well-bore 124 is a tubular pipe 160 that includes an inner conductor 162, an outer conductor 164 and the RF antenna 140. As will be discussed below, the tubular pipe 160 also provides a plurality of spaced apart passageways extending therethrough. These passageways extend from the wellhead 138 to the gas lift passageway at the illustrated gas lift 150 at the bottom of the wellbore 124.

The RF transmission line 142 is defined by the inner conductor 162 and the outer conductor 164, with the outer conductor 164 surrounding the inner conductor in space relation therefrom. The inner conductor 162 has a cooling fluid passageway 170 therethrough coupled to the gas source 132. The cooling fluid passageway 170 is for the flow of gas 144 to the gas lift 150. The RF antenna 140 surrounds the outer conductor 164 in spaced relation therefrom.

The space between the inner and outer conductors 162, 164 defines a hydrocarbon resource recovery passageway 172 in fluid communication with the gas lift passageway to lift the mixture of the hydrocarbon resources 146 and the gas from the wellbore 124.

The space between the outer conductor 164 and the RF antenna 140 may define an additional gas lift passageway 174 in fluid communication with the gas lift passageway to provide an additional lift of the mixture of the hydrocarbon resources 146 and the gas from the wellbore 124. Alternatively, the space between the outer conductor 164 and the RF antenna 140 may define an additional cooling fluid passageway coupled to the gas source 132.

Figure 8:
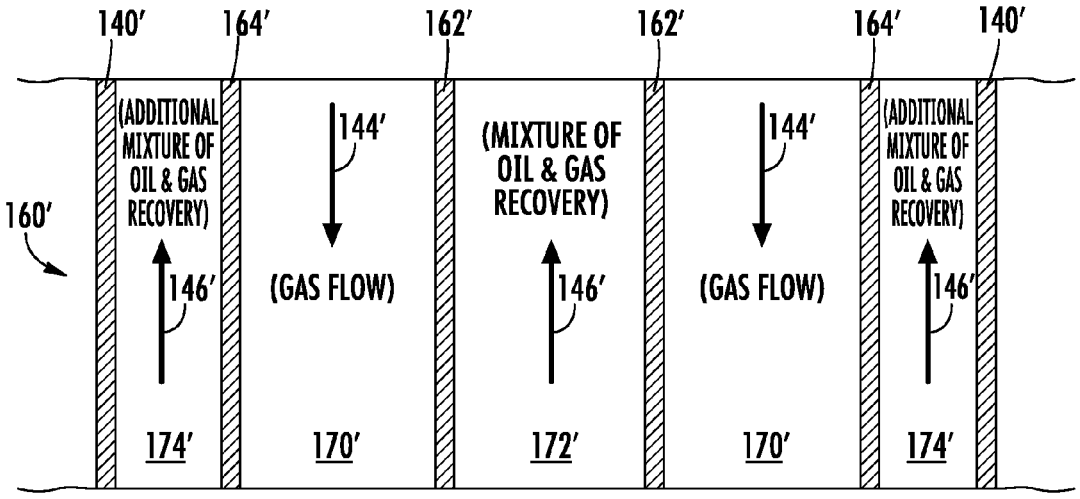
FIG. 8 is an enlarged cross-sectional view of another embodiment of the hydrocarbon resource recovery apparatus within section A of the wellbore in FIG. 6.

Another embodiment of the cross-sectional view of the wellbore 124' at section A will now be discussed with reference to FIG. 8. In this embodiment, the RF transmission line 142' is still defined by the inner conductor 162' and the outer conductor 164', with the outer conductor 164' surrounding the inner conductor in space relation therefrom. However, the space between the inner and outer conductors 162', 164' now defines the cooling fluid passageway 170' coupled to the gas source 132'. The cooling fluid passageway 170' is for the flow of gas 144'.

The inner conductor 162' defines a hydrocarbon resource recovery passageway 172' in fluid communication with the gas lift passageway to lift the mixture of the hydrocarbon resources 146' and the gas from the wellbore 124'.

The space between the outer conductor 164" and the RF antenna 140' may define an additional gas lift passageway 174' in fluid communication with the gas lift passageway to provide an additional lift of the mixture of the hydrocarbon resources 146' and the gas from the wellbore 124'. Alternatively, the outer conductor 164" and the RF antenna 140' may define an additional cooling fluid passageway coupled to the gas source 132.

Figure 9:
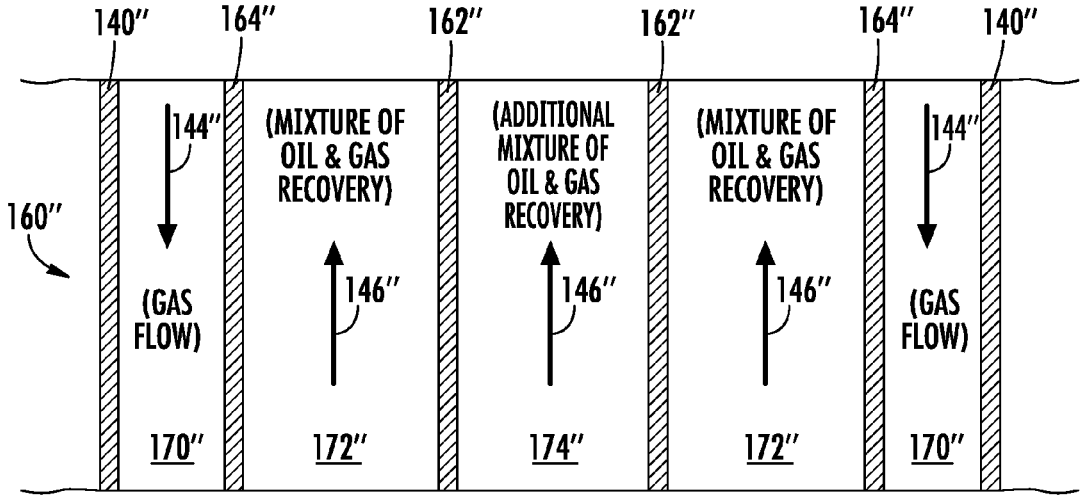
FIG. 9 is an enlarged cross-sectional view of yet another embodiment of the hydrocarbon resource recovery apparatus within section A of the wellbore in FIG. 6.

Yet another embodiment of the cross-sectional view of the wellbore 124" at section A will now be discussed with reference to FIG. 9. In this embodiment, the RF transmission line 142" is still defined by the inner conductor 162" and the outer conductor 164", with the outer conductor 164" surrounding the inner conductor in space relation therefrom. However, the space between the outer conductor 164" and the antenna 140" now defines the cooling fluid passageway 170' coupled to the gas source 132". The cooling fluid passageway 170' is for the flow of gas 144".

The space between the inner and outer conductors 162", 164" defines a hydrocarbon resource recovery passageway 172" in fluid communication with the gas lift passageway to lift the mixture of the hydrocarbon resources 146" and the gas from the wellbore 124".

The space between the inner and outer conductors 162", 164" may define an additional gas lift passageway 174" in fluid communication with the gas lift passageway to provide an additional lift of the mixture of the hydrocarbon resources 146" and the gas from the wellbore 124". Alternatively, the space between the inner and outer conductors 162", 164" may define an additional cooling fluid passageway coupled to the gas source 132".

Figure 10:
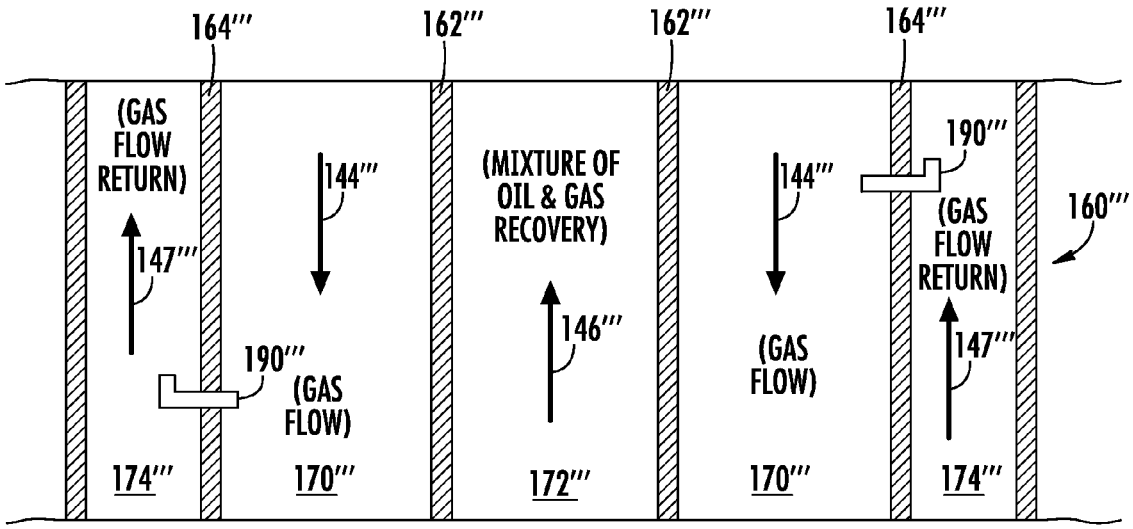
FIG. 10 is an enlarged cross-sectional view of another embodiment of the hydrocarbon resource recovery apparatus with side pocket mandrels or gas lift injection valves within section A of the wellbore in FIG. 6.

Referring now to FIG. 10, another embodiment of the cross-sectional view of the wellbore 124''' at section A includes side pocket mandrels or gas lift injection valves 190'''. In this embodiment, the side pocket mandrels or gas lift injection valves 190''' allow the flow of gas 144''' to be split.

The RF transmission line 142''' is still defined by the inner conductor 162''' and the outer conductor 164''', with the outer conductor 164''' surrounding the inner conductor in space relation therefrom. The space between the inner and outer conductors 162''', 164''' defines the cooling fluid passageway 170''' coupled to the gas source 132'''. The cooling fluid passageway 170''' is for the flow of gas 144'''.

The side pocket mandrels or gas lift injection valves 190''' allow the flow of gas 144''' to be split. One split is for the inner conductor 162''' defining a hydrocarbon resource recovery passageway 172''' in fluid communication with the gas lift passageway to lift the mixture of the hydrocarbon resources 146''' and the gas from the wellbore 124'''.

Another split is for the space between the outer conductor 164''' and the RF antenna 140''' defining a gas flow return passageway 174''' in fluid communication with the gas lift passageway to provide a clean return 147''' for the gas from the wellbore 124'''. The side pocket mandrels or gas lift injection valves 190''' may be positioned in different locations within the wellbore so that the other passageways may be utilized for the clean return of the gas flow 147''' and for the mixture of the oil and gas recovery 146''', as readily appreciated by those skilled in the art.

Figure 11:
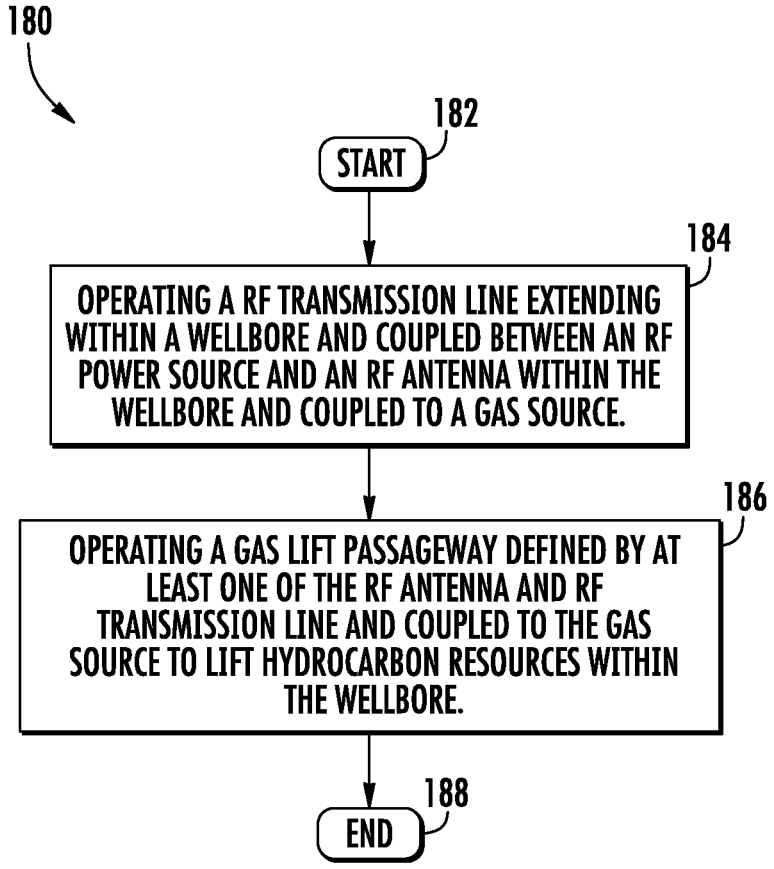
FIG. 11 is a flowchart for a hydrocarbon resource recovery method for a subterranean formation having a wellbore extending therein as illustrated in FIG. 6.

Referring now to the flowchart 180 in FIG. 11, a hydrocarbon resource recovery method for a subterranean formation 122 having a wellbore 124 extending therein includes, from the start (Block 182), operating the RF transmission line 142 at Block 184 extending within the wellbore 124 and coupled between the RF power source 130 and the RF antenna within the wellbore and coupled to the gas source 130 and cooled by a flow of gas therefrom. The gas lift passageway defined by at least one of the RF antenna 140 and RF transmission line 142 and coupled to the gas source 132 is operated at Block 186 to lift hydrocarbon resources 146 within the wellbore 124. The method ends at Block 188.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hydrocarbon resource recovery apparatus for a subterranean formation having a wellbore extending therein, the apparatus comprising:

a radio frequency (RF) power source;

a gas source;

an RF antenna within the wellbore;

an RF transmission line extending within the wellbore between said RF power source and said RF antenna and coupled to said gas source to be cooled by a flow of gas therefrom; and at least one of said RF antenna and RF transmission line defining a gas lift passageway coupled to said gas source to lift hydrocarbon resources within the wellbore.

2. The hydrocarbon resource recovery apparatus according to claim 1 wherein said transmission line comprises an inner conductor and an outer conductor surrounding said inner conductor in space relation therefrom; and wherein said inner conductor has a cooling fluid passageway therethrough in fluid communication with said gas source.

3. The hydrocarbon resource recovery apparatus according to claim 1 wherein said transmission line comprises an inner conductor and an outer conductor surrounding said inner conductor in spaced relation therefrom; and wherein the space between said inner and outer conductors defines a cooling fluid passageway in fluid communication with said gas source.

4. The hydrocarbon resource recovery apparatus according to claim 1 wherein said transmission line comprises an inner conductor and an outer conductor surrounding said inner conductor in spaced relation therefrom; and wherein said RF antenna surrounds said outer conductor in spaced relation therefrom; and wherein the space between said outer conductor and said RF antenna defines a cooling fluid passageway in fluid communication with said gas source.

5. The hydrocarbon resource recovery apparatus according to claim 1 wherein said transmission line comprises an inner conductor and an outer conductor surrounding said inner conductor in space relation therefrom; and wherein said inner conductor has a hydrocarbon resource recovery passageway therethrough in fluid communication with the gas lift passageway to lift hydrocarbon resources from the wellbore.

6. The hydrocarbon resource recovery apparatus according to claim 1 wherein said transmission line comprises an inner conductor and an outer conductor surrounding said inner conductor in spaced relation therefrom; and wherein the space between said inner and outer conductors defines a hydrocarbon resource recovery passageway in fluid communication with the gas lift passageway to lift hydrocarbon resources from the wellbore.

7. The hydrocarbon resource recovery apparatus according to claim 1 wherein said transmission line comprises an inner conductor and an outer conductor surrounding said inner conductor in spaced relation therefrom; and wherein said RF antenna surrounds said outer conductor in spaced relation therefrom; and wherein the space between said outer conductor and said RF antenna defines a hydrocarbon resource recovery passageway in fluid communication with the gas lift passageway to lift hydrocarbon resources from the wellbore.

8. The hydrocarbon resource recovery apparatus according to claim 1 wherein said gas source comprises at least one of a nitrogen source and a natural gas source.

9. The hydrocarbon resource recovery apparatus according to claim 1 wherein said RF antenna comprises a dipole RF antenna.

10. The hydrocarbon resource recovery apparatus according to claim 1 wherein the wellbore extends in a vertical direction.

11. A hydrocarbon resource recovery apparatus for a subterranean formation having a wellbore extending therein, the apparatus comprising:

a radio frequency (RF) antenna within the wellbore;

an RF transmission line extending within the wellbore coupled between an RF power source and said RF antenna and coupled to a gas source to be cooled by a flow of gas therefrom; and at least one of said RF antenna and RF transmission line defining a gas lift passageway coupled to said gas source to lift hydrocarbon resources within the wellbore.

12. The hydrocarbon resource recovery apparatus according to claim 11 wherein said RF transmission line comprises an inner conductor and an outer conductor surrounding said inner conductor in space relation therefrom; and wherein said inner conductor has a cooling fluid passageway therethrough coupled to the gas source.

13. The hydrocarbon resource recovery apparatus according to claim 11 wherein said RF transmission line comprises an inner conductor and an outer conductor surrounding said inner conductor in spaced relation therefrom; and wherein the space between said inner and outer conductors defines a cooling fluid passageway coupled to the gas source.

14. The hydrocarbon resource recovery apparatus according to claim 11 wherein said RF transmission line comprises an inner conductor and an outer conductor surrounding said inner conductor in spaced relation therefrom; and wherein said RF antenna surrounds said outer conductor in spaced relation therefrom; and wherein the space between said outer conductor and said RF antenna defines a cooling fluid passageway coupled to the gas source.

15. The hydrocarbon resource recovery apparatus according to claim 11 wherein said RF transmission line comprises an inner conductor and an outer conductor surrounding said inner conductor in space relation therefrom; and wherein said inner conductor has a hydrocarbon resource recovery passageway therethrough coupled to the gas lift passageway to lift hydrocarbon resources from the wellbore.

16. The hydrocarbon resource recovery apparatus according to claim 11 wherein said RF transmission line comprises an inner conductor and an outer conductor surrounding said inner conductor in spaced relation therefrom; and wherein the space between said inner and outer conductors defines a hydrocarbon resource recovery passageway coupled to the gas lift passageway to lift hydrocarbon resources from the wellbore.

17. The hydrocarbon resource recovery apparatus according to claim 11 wherein said RF transmission line comprises an inner conductor and an outer conductor surrounding said inner conductor in spaced relation therefrom; and wherein said RF antenna surrounds said outer conductor in spaced relation therefrom; and wherein the space between said outer conductor and said RF antenna defines a hydrocarbon resource recovery passageway coupled to the gas lift passageway to lift hydrocarbon resources from the wellbore.

18. A hydrocarbon resource recovery method for a subterranean formation having a wellbore extending therein, the method comprising:

operating a radio frequency (RF) transmission line extending within the wellbore and coupled between an RF power source and an RF antenna within the wellbore and coupled to a gas source and cooled by a flow of gas therefrom; and operating a gas lift passageway defined by at least one of the RF antenna and RF transmission line and coupled to the gas source to lift hydrocarbon resources within the wellbore.

19. The method according to claim 18 wherein the RF transmission line comprises an inner conductor and an outer conductor surrounding the inner conductor in space relation therefrom; and wherein the inner conductor has a cooling fluid passageway therethrough coupled to the gas source.

20. The method according to claim 18 wherein the RF transmission line comprises an inner conductor and an outer conductor surrounding the inner conductor in spaced relation therefrom; and wherein the space between the inner and outer conductors defines a cooling fluid passageway coupled to the gas source.

21. The method according to claim 18 wherein the RF transmission line comprises an inner conductor and an outer conductor surrounding the inner conductor in spaced relation therefrom; and wherein the RF antenna surrounds the outer conductor in spaced relation therefrom; and wherein the space between the outer conductor and the RF antenna defines a cooling fluid passageway coupled to the gas source.

22. The method according to claim 18 wherein the RF transmission line comprises an inner conductor and an outer conductor surrounding the inner conductor in space relation therefrom; and wherein the inner conductor has a hydrocarbon resource recovery passageway therethrough coupled to the gas lift passageway to lift hydrocarbon resources from the wellbore.

23. The method according to claim 18 wherein the RF transmission line comprises an inner conductor and an outer conductor surrounding the inner conductor in spaced relation therefrom; and wherein the space between the inner and outer conductors defines a hydrocarbon resource recovery passageway coupled to the gas lift passageway to lift hydrocarbon resources from the wellbore.

24. The method according to claim 18 wherein the RF transmission line comprises an inner conductor and an outer conductor surrounding the inner conductor in spaced relation therefrom; and wherein the RF antenna surrounds the outer conductor in spaced relation therefrom; and wherein the space between the outer conductor and the RF antenna defines a hydrocarbon resource recovery passageway coupled to the gas lift passageway to lift hydrocarbon resources from the wellbore.

* * * * *